US005424818A

United States Patent [19]

Yoshimura et al.

[11] Patent Number: 5,424,818

[45] Date of Patent: Jun. 13, 1995

[54] TONER IMAGE TRANSFERRING APPARATUS AND POSITIONAL ARRANGEMENT OF CONVEYING ROLLER

[75] Inventors: Osamu Yoshimura; Shigeki Hayashi; Hiroshi Ishida; Hiroshi Kubota, all of Osaka; Yasuo Hatade, Kagoshima; Masahiro Hashizume, Osaka; Hiroyuki Ueda, Osaka; Tadakazu Ogiri, Osaka, all of Japan

[73] Assignee: Mita Industrial Co., Ltd., Osaka, Japan

[21] Appl. No.: 157,238

[22] Filed: Nov. 24, 1993

[30] Foreign Application Priority Data

Nov. 26, 1992 [JP] Japan ..... 4-316850
May 26, 1993 [JP] Japan ..... 5-124135

[51] Int. Cl.[6] ..... G03G 15/16

[52] U.S. Cl. ..... 355/274; 355/309

[58] Field of Search ..... 355/271, 273, 274, 275, 355/276, 277, 308, 309

[56] References Cited

U.S. PATENT DOCUMENTS

| | | | |
|---|---|---|---|
| 3,893,760 | 7/1975 | Thettu | 355/315 |
| 4,396,273 | 8/1983 | Matsuyama et al. | 355/274 |
| 4,401,383 | 8/1983 | Suzuki et al. | 355/272 |
| 4,809,033 | 2/1989 | Ikemoto et al. | 355/271 |
| 5,126,796 | 6/1992 | Fujii et al. | 355/271 |
| 5,130,752 | 7/1992 | Morishita et al. | 355/274 |
| 5,138,396 | 8/1992 | Satou et al. | 355/308 |
| 5,268,724 | 12/1993 | Koizumi et al. | 355/274 |
| 5,276,489 | 1/1994 | Kikuchi et al. | 355/274 |

FOREIGN PATENT DOCUMENTS

| | | | |
|---|---|---|---|
| 0382448 | 8/1990 | European Pat. Off. . | |
| 0452795 | 10/1991 | European Pat. Off. . | |
| 4304295 | 8/1993 | Germany . | |
| 0290461 | 12/1986 | Japan | 355/274 |
| 0053988 | 2/1992 | Japan | 355/274 |
| 0101181 | 4/1992 | Japan | 355/274 |
| 2192154 | 1/1988 | United Kingdom . | |

OTHER PUBLICATIONS

Patent Abstract of Japan, 56-121060 to Sagar dated Dec. 19,1981.

Patent Abstract of Japan, 57-084471 to Kunio dated Sep. 2, 1992.

Patent Abstract of Japan, 04-336575 to Takashi dated Apr. 9, 1993.

Sanchez, "Pre-Transfer Idler Roll with Baffle", *Xerox Disclosure Journal*, vol. 16, No. 3, May/Jun., 1990, pp. 195-196.

Patent Abstract of Japan, 58-125075 to Kasama dated Oct. 22, 1983.

Patent Abstract of Japan, 57-189166 to Shibuya dated Feb. 10, 1983.

*Primary Examiner*—Robert B. Beatty
*Attorney, Agent, or Firm*—Beveridge, DeGrandi, Weilacher & Young

[57] ABSTRACT

A transferring apparatus transfers a toner image formed on the surface of a photoreceptor drum onto a sheet. The photoreceptor drum surface and a transfer roller are arranged in such manner that a gap larger than the thickness of the sheet is left between the photoreceptor drum and transfer roller, and a lower guide member for guiding the sheet in such direction that the sheet abuts the drum surface at a predetermined angle is arranged between a resist roller pair and the drum. The sheet which abuts the drum surface by way of the upper surface of the guide member is in close contact with the drum surface while being bent and deformed along the drum surface. A conveying roller is provided, opposite the upper surface of the lower guide member, with a predetermined gap between, at a position close to but out of contact with the drum surface. The conveying roller may also be arranged to contact the transfer roller.

8 Claims, 7 Drawing Sheets

TONER IMAGE TRANSFERRING APPARATUS AND POSITIONAL ARRANGEMENT OF CONVEYING ROLLER

BACKGROUND OF THE INVENTION

1. Field of the Invention

The present invention relates to a transferring apparatus, incorporated in an image forming apparatus such as an electronic copying machine, a printer and a facsimile machine, for transferring a toner image formed on the surface of an electrostatic latent image carrier incorporated in the image forming apparatus onto a sheet such as a transfer sheet.

2. Description of the Prior Art

Two typical apparatuses for performing electrostatic transfer of a toner image formed on the surface of an electrostatic latent image carrier in an image forming apparatus, such as an electronic copying machine, are an apparatus employing a non-contact-type corona transfer method where a corona discharger is used as a means for supplying a charge to the carrier, and an apparatus employing a contact-type bias roller transfer method where a conductive roller is used as the charge supplying means.

In the former transferring apparatus employing the corona transfer method, as schematically shown in FIG. 1, a corona discharger 22 is arranged in such manner that a necessary gap is left between the discharger 22 and a photoreceptor drum 21 which serves as the electrostatic latent image carrier, and a sheet P transported between the rotating drum 21 and the discharger 22 is made to partly adhere to the drum surface by charging the sheet P by applying a corona charge of a polarity reverse to that of toner from the back side of the sheet P, and the charged toner on the drum surface is transferred to the sheet P by the Coulomb's force.

In the case of the corona transfer method, however, since the sheet P adhering to the drum 21 due to the working of electrostatic force frequently does not spontaneously separate from the drum surface, it is necessary to provide a separating means. Moreover, since a high voltage is applied to the discharger 22, ozone which is harmful to the human body is generated in a considerable amount.

On the contrary, in the latter transferring apparatus employing the bias roller transfer method, as schematically shown in FIG. 2, a transfer roller 23 made of urethane resin provided with conductivity by being mixed with carbon or alkali metal is arranged so as to be rotatively in contact with the photoreceptor drum 21, and the transfer sheet P admitted between the peripheries of the drum 21 and the transfer roller 23 is pressed by the transfer roller 23 onto the toner adhering to the drum surface and the toner image on the drum surface 21 is transferred onto the sheet P by applying to the axial core of the transfer roller 23 a transfer voltage of a polarity reverse to that of the toner. This method is more advantageous than the above-mentioned corona transfer method in that the generation of ozone is smaller and no sheet separating means is necessary.

In the bias transfer method, however, since the surface of the drum 21 and the surface of the transfer roller 23 are pressed against each other with the sheet P between, it is apt to occur that the toner located at a central portion of the drum 21 is not transferred to the sheet P and that toner scatters and adheres to a peripheral portion of the image transferred onto the sheet.

To solve these problems of the bias roller transfer method, the present applicant proposed in Japanese Patent Application No. H4-284120 an arrangement as schematically shown in FIG. 3, wherein the transfer roller 23 is arranged so that a gap larger than the thickness of the sheet P is left between the photoreceptor drum 21 and the roller 23 in order that the roller 23 remains out of contact with the drum 21 and the sheet P to thereby prevent the occurrence of the above-mentioned problems.

In FIG. 3, 24 represents a resist roller pair for transporting the sheet, **25*a* and 25*b* represent guide members for guiding the sheet P to the drum surface, and 26** represents a guide table for guiding to a fixing roller pair (not shown) the sheet P onto which the image has been transferred.

In the case of the above-mentioned prior art, it is considered that the reason why the toner image on the drum surface is appropriately and excellently transferred onto the sheet P in spite of the fact that the transfer roller 23 is separated from the surface of the drum 21 is that a slight corona discharge is generated from the transfer roller 23 toward the rear surface of the sheet P. Actually, excellent test results have been obtained with respect to the transfer performance of the toner image.

However, since nothing supports the sheet P from the rear side because the transfer roller 23 is out of contact with the drum surface, the movement of the sheet P is unstable, thereby causing a variation in contact pressure between the sheet P and the drum surface. As a result, the transferred image is uneven.

That is, in the above prior art, the resist roller pair 24 sends out the sheet P in correspondence with the rotation of the drum 21 at a speed equal to the peripheral speed of the drum surface, so that the sheet P is guided toward the drum along the guide members **25*a* and 25*b*. After the front end of the sheet P passes by the end portion of the lower guide member 25*b* and abuts the drum surface, the sheet P moves at a speed equal to the peripheral speed of the drum surface while being in close contact with the transfer area on the drum surface by being bent along the surface of the drum 21, and by the time the sheet P is separated from the drum surface, the toner image is transferred onto the sheet which is in close contact with the transfer area on the drum surface by the working of the transfer roller 23** from the rear side of the sheet P.

The sheet P which has been separated from the drum surface, although depending on its length, moves toward the downstream side on the sheet conveying path while being weighed down by its own dead load, and after reaching the upper surface of the guide table 26, it is separated from the resist roller 24 and transported along the guide table 26 in accordance with the rotation of the drum 21. As described above, the sheet P bends at a portion just in front of the portion of the sheet P which abuts the drum surface and at a portion at which the sheet P comes into contact with the guide table 26, and the resiliency of the sheet P generated by the bend works as the contact pressure on the portion of the sheet P which is in contact with the drum surface.

The conveying speed of the sheet P and the inclination angles of the guide surfaces of the guide members **25*a* and 25*b*** are set to fit the conditions to make the sheet P to be in close contact with the drum surface while being conveyed at a speed equal to the peripheral speed of the drum surface. In actuality, however, the resiliency of the sheet P varies according to environmental conditions such as the temperature and humidity around the transfer area.

For this reason, it is unavoidable that the sheet P is not in contact with the drum surface with a necessary contact pressure because the sheet is excessively bent, that is, excessively weighed down and that the position relationship between the toner image on the drum 21 and the sheet P is shifted because of accumulative errors caused in the sheet feeding speed of sheet feeding rollers provided at a plurality of positions in a paper feeding mechanism.

Such error factors relating to paper feeding cause no problems in the case of the conventional contact-type transfer roller since the roller rotates in synchronism with the drum 21 to restrict the conveying speed of the sheet P. However, when the transfer roller is out of contact with the drum 21 like in the above prior art, since no means is provided for forcibly restricting the conveying speed and the transfer timing of the sheet P, it is impossible for structural reasons to prevent the transferred image from being uneven.

The sheet P which has been separated from the drum 21 is pulled by the fixing roller pair after the separation. At this time, since the peripheral speed slightly differs between the fixing roller pair and the resist roller pair 24, the sheet P may excessively be pulled by the fixing roller pair or it may be bent between the drum 21 and the fixing roller pair. However, regarding this point, normally, the diameters of the rollers constituting the resist roller pair 24 and the fixing roller pair are each set so that the sheet P is slightly bent between the roller pairs.

Moreover, when the sheet P is short, the rear end thereof may be separated from the resist roller pair 24 while transfer is still being performed. For such a case, utilizing the fact that the sheet P is attracted to the drum surface by the attraction caused by the electrostatic force, the rollers and guide members are arranged in a manner such that the sheet P is conveyed to the fixing roller pair without any position shift or disorder by making the drum surface attract a part of the sheet P by use of the attraction by the electrostatic force.

In the arrangement of the above prior art, however, although the movement speed of the sheet P and the peripheral speed of the drum surface are maintained coincident with each other when the sheet P is caught between the resist rollers 24 as shown in FIG. 3, after the rear end of the sheet P is separated from the resist roller pair 24 as shown in FIG. 4, since the sheet P comes into close contact with the upper guide member 25*a* due to its resiliency, and its movement speed slightly changes, the electrostatic latent image formed on the drum surface is transferred, at the rear portion of the sheet P, in a condition where the position is slightly shifted.

Moreover, if the angle of inclination of the upper guide member 25*a* is displaced to an angle which is nearly horizontal as shown in FIG. 5 so that the rear end portion of the sheet P separated from the resist roller 24 does not interfere with the upper guide member 25*a*, the admission angle of the sheet P to the drum surface is displaced to change the contact condition of the sheet P with the transfer area of the drum surface, thereby changing the image density. Therefore, when a high-quality image is required, it is difficult to realize a sufficient transfer accuracy only by exactly setting the arrangement of the rollers and guide members or changing the position of the guide members.

SUMMARY OF THE INVENTION

An object of the present invention is to provide a transferring apparatus where the formation of uneven images is prevented to the utmost by forcibly conveying a transfer sheet in such direction that the sheet is brought into contact with the surface of an electrostatic latent image carrier in an arrangement where a charge supplying means such as a transfer roller is arranged to be out of contact with the electrostatic latent image carrier such as a photoreceptor drum.

A transferring apparatus of the present invention is provided with an electrostatic latent image carrier moving in a direction corresponding to a conveying direction of a transfer sheet, charge supplying means arranged at a position opposite the electrostatic latent image carrier with a sheet conveying path between in such manner that a gap larger than a thickness of the transfer sheet is left between a surface of the electrostatic latent image carrier and the charge supplying means, said charge supplying means being charged reversely to toner adhering to the surface of the electrostatic latent image carrier, a conveying roller for forcibly conveying the transfer sheet in such direction that the sheet comes into contact with the surface of the electrostatic latent image carrier, said conveying roller being arranged at a position, on the sheet conveying path, which is close to but out of contact with the electrostatic latent image carrier, and roller driving means for rotating the conveying roller at a peripheral speed equal to a peripheral speed of the electrostatic latent image carrier.

According to the transferring apparatus of the present invention, not only the problems that the toner located at a central portion of the drum is not transferred to the sheet and that toner scatters and adheres to a peripheral portion of the image transferred onto the sheet are prevented by arranging the charge supplying means so as to be out of contact with the surface of the electrostatic latent image carrier, but also the sheet may be in contact with the surface of the carrier at a sufficient contact pressure by providing a stable conveying force to the transfer sheet by the conveying roller and immediately thereafter bringing the sheet into contact with the surface of the carrier along the surface of the carrier. Consequently, even when the resiliency of the sheet varies with environmental conditions such as the temperature and humidity, the sheet may be brought into contact with the surface of the carrier at a stable contact pressure. As a result, an excellent image without any blur is obtained on the sheet.

Moreover, after the rear end of the transfer sheet is separated from the resist roller pair, the sheet is bent by its own resiliency between the surface of the carrier and the front end portion of the guide member, and thereby, the bent portion of the sheet is pressed onto the transfer roller, so that a driving force in the conveying direction is provided from the conveying roller. Consequently, after the sheet is separated from the resist roller pair, the conveying roller supplements the conveying force of the sheet until the sheet, from its front to rear ends, is attracted to the surface of the carrier due to the electrostatic force. As a result, the sheet from its front to rear ends, may be brought into contact with the surface of the carrier at a stable contact pressure.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
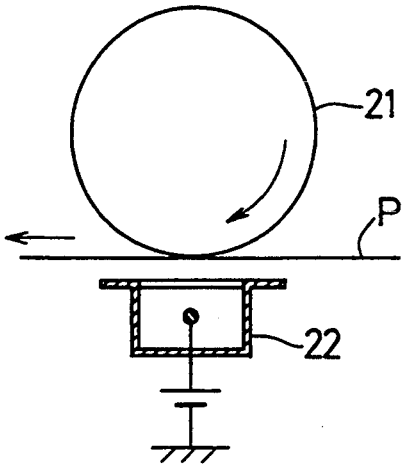
Fig.1 prior art
FIG. 1 schematically shows a conventional transferring apparatus employing a corona transfer method.
Figure 2:
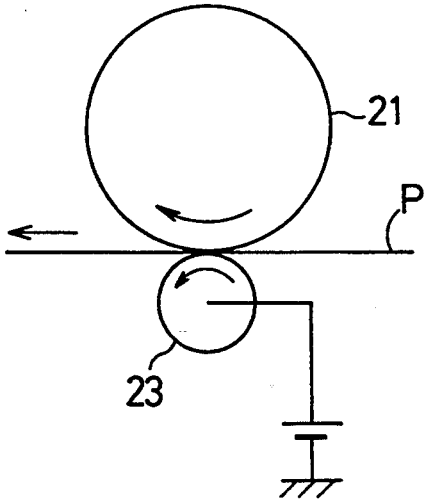
Fig.2 prior art
FIG. 2 schematically shows a conventional transferring apparatus employing a bias transfer method.
Figure 3:
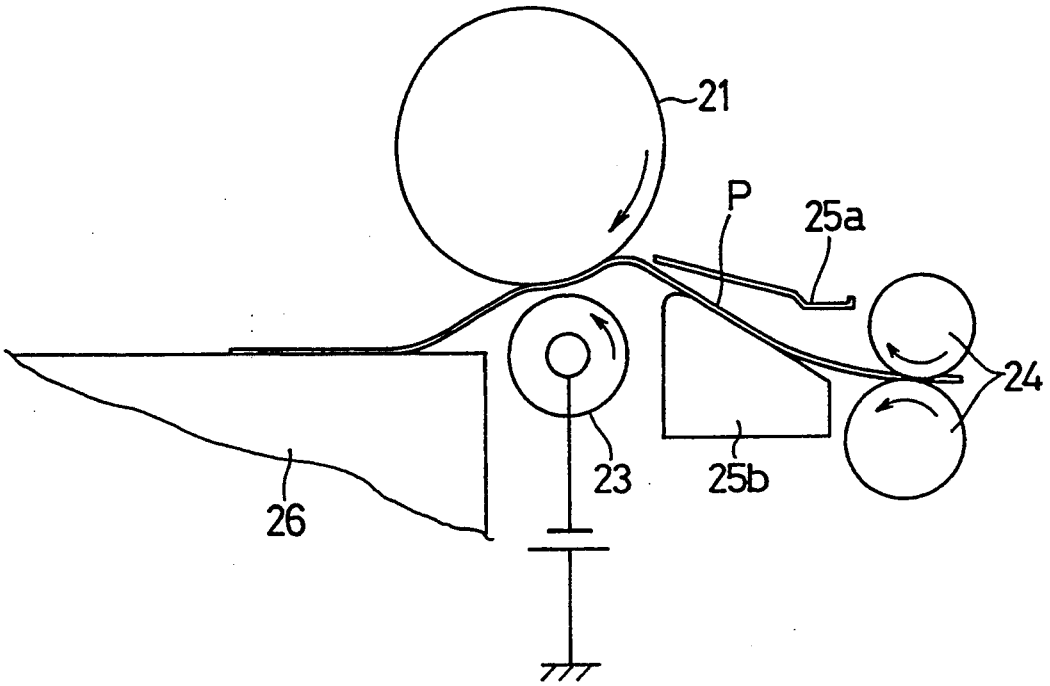
Fig.3 prior art
FIG. 3 schematically shows a relevant portion of another prior art device.
Figure 4:
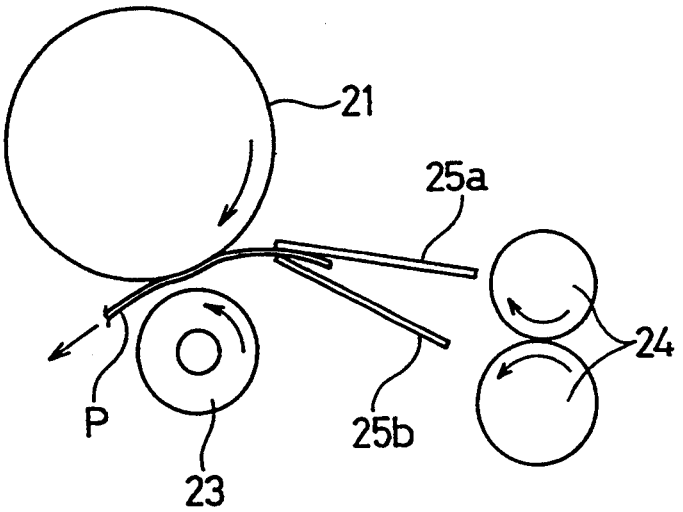
Fig.4 prior art
FIG. 4 schematically shows a defect of the prior art of FIG. 3.
Figure 5:
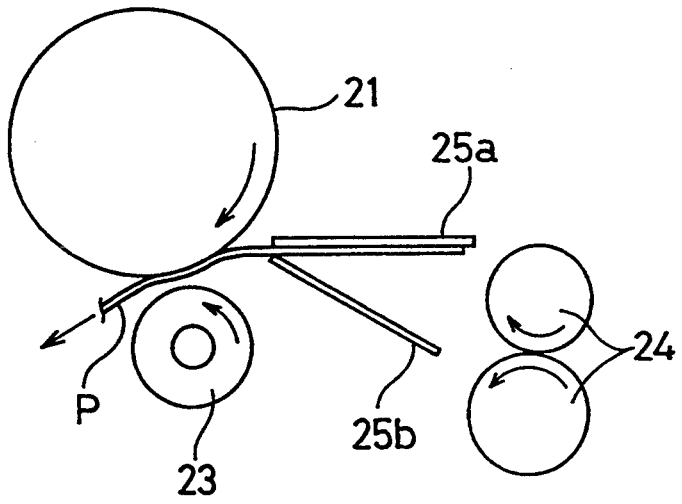
Fig.5 prior art
FIG. 5 schematically shows an undesirable condition of a modification of the prior art of FIG. 3.
Figure 6:
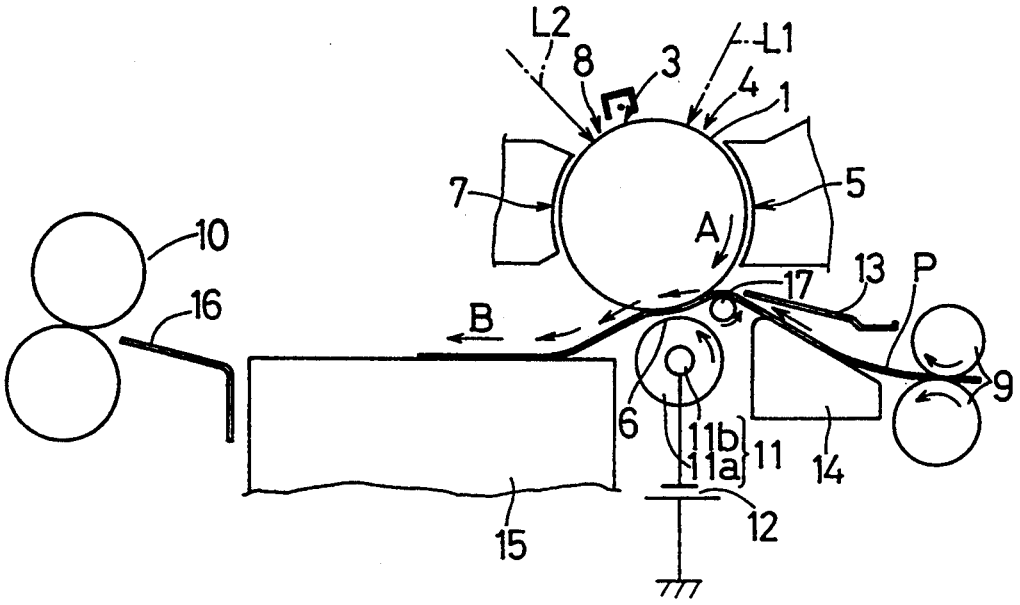
FIG. 6 schematically shows a relevant portion of a copying machine incorporating a transferring apparatus which is a first embodiment of the present invention.
Figure 7:
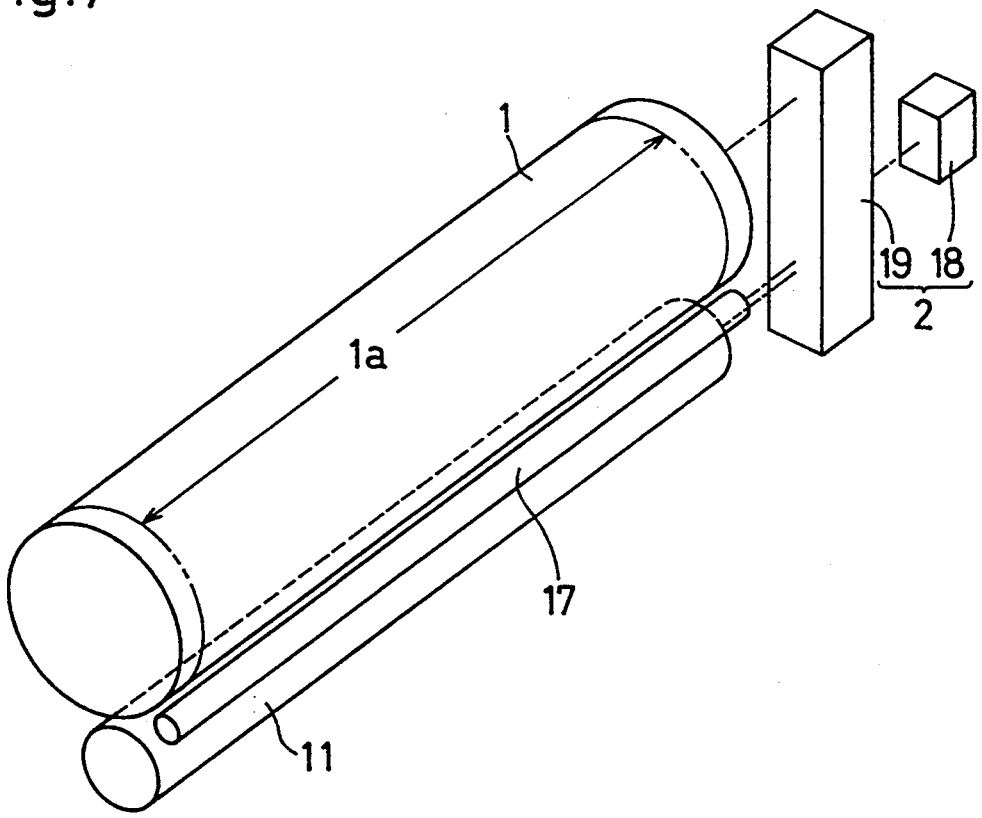
FIG. 7 is an enlarged perspective view of a part of the portion of FIG. 6.

FIGS. 6 and 7 show a first embodiment of the present invention. In this embodiment, the present invention is employed in a transferring apparatus of an electronic copying apparatus. FIG. 6 schematically shows a relevant portion of the copying machine. The reference numeral 1 represents a photoreceptor drum which serves as an electrostatic latent image carrier. The photoreceptor drum 1 is constituted by a tube made of a metal such as aluminum on which a photosensitive layer made of amorphous silicon (a-Si) or other photosensitive material is formed.

The drum 1 is arranged nearly horizontally in the copying machine body, and is rotated clockwise (i.e. in a direction shown by arrow A) by a driving system 2 (see FIG. 7) provided in the copying machine body. The rotation direction of the drum 1 is set to a direction corresponding to the conveying direction of a transfer sheet (i.e. sheet for transferring) P in a subsequently-described transfer area. On the drum surface, a charging area 3, an exposure area 4, a development area 5, a transfer area 6, a cleaning area 7 and a charge-removal area 8 are set in this order in the rotation direction of the drum 1.

In the copying machine having the arrangement described above, the photosensitive layer on the surface of the drum 1 is charged by corona discharge at the charging area 3. To the charged drum surface, a reflected light L1 of an image read out from an original by a non-illustrated optical system provided in the copying machine is irradiated at the exposure area 4 to form an electrostatic latent image.

To the electrostatic latent image, charged toner is applied at the development area 5 to form a toner image. Then, at the transfer area 6, the toner image on the surface of the drum 1 is, as subsequently described in detail, transferred onto the transfer sheet P fed by a resist roller pair 9 along a sheet conveying path shown by the arrows B.

After the transfer, toner remaining on the drum surface is removed at the cleaning area 7, and at the charge-removal area 8, a charge removing light L2 is irradiated onto the drum, thereby removing the charge so that the drum 1 is ready for the next charging when it has just made one revolution. The sheet P on which the toner image is transferred at the transfer area 6 is sent to a fixing roller pair 10, and heated and pressurized while it is passing through the fixing roller pair 10 to fix the toner image on the sheet P.

In the copying machine having the arrangement described above, the transferring apparatus employing this embodiment is provided with respect to the transfer area 6 on the drum surface. FIG. 7 shows the arrangement relationship between the drum 1, and a charge supplying means and a conveying roller constituting a main portion of the present invention. In FIGS. 6 and 7, the reference numeral 11 is a transfer roller which serves as the charge supplying means, arranged below the drum 1 in parallel with the drum axis at a position closely opposite to the surface of the drum 1 with the sheet conveying path B and a gap larger than the thickness of the sheet P.

The transfer roller 11 transfers the charged toner adhering to the drum surface to the sheet P at the development area 5 by being provided with a voltage of a polarity reverse to that of the charged toner during transferring. The roller 11 is of a long-axis roller form where a roller body 11*a* having a length at least longer than the length, along the drum axis, of a toner image forming area 1*a* on the drum surface is integrally fixed around a rotation axis 11*b*.

The roller body 11*a* of the transfer roller 11 may be made of a conductive resin material or a conductive rubber material such as polystyrene resin or urethane resin in which, for example, carbon or an alkali metal is mixed. In FIG. 6, the reference numeral 12 represents a power source for supplying a transfer voltage to the transfer roller 11.

Between the resist roller pair 9 and the drum 1 are arranged upper and lower guide members 13 and 14 so as to oppose each other with the sheet conveying path B between. Moreover, in the downstream side of the transfer roller 11 along the sheet conveying path B is arranged a guide table 15. The reference numeral 16 represents a sheet guide arranged between the guide table 15 and the fixing roller pair 10.

The lower guide member 14 guides the sheet P fed by the resist roller pair 9 in such direction that the sheet P abuts the surface of the drum 1 at a predetermined admission angle. The upper surface thereof is a flat slanting surface rising at a predetermined angle toward the drum 1.

The upper guide member 13 prevents the sheet P from being separated from the lower guide member 14 while the sheet P is being sent, and when toner drops from the development area 5, it prevents toner from dropping onto the sheet P and adhering thereto. The upper guide member 13 is slanted so that it is closer to the lower guide member 14 as it approaches the drum 1. The guide table 15 is arranged closely to the transfer roller 11, and the upper surface thereof is located at a position lower than the lower end of the drum 1.

In this embodiment, in the arrangement described above, a conveying roller 17 is provided at a position on the sheet conveying path B and close to but out of contact with the drum 1. The conveying roller 17 is provided to forcibly convey the sheet P fed to the drum surface by being guided by the lower guide member 14 in such direction that the sheet P comes into contact with the drum surface. Specifically, it is arranged at a position as close to the drum surface as possible between the slanting upper surface of the lower guide member 14 and the drum surface, is reversely driven at a peripheral speed equal to the peripheral speed of the drum surface, and is formed in such manner that an upper portion of its periphery abuts the rear surface of the sheet P.

Moreover, the conveying roller 17 is made of a material such as conductive silicon rubber having a relatively large friction coefficient. Further, similarly to the transfer roller 11, it is necessary for the conveying roller 17 to be longer than the length, along the drum axis, of the toner image forming area 1*a* on the drum surface. The conveying roller 17 may be of a form of one roller as shown in FIG. 7, or it may be constituted by a plurality of short rollers which can simultaneously be rotated about the same axis.

As far as the conveying of the sheet P is not hindered, the shorter the diameter of the roller is, the more advantageous it is to arranging the roller closely to the drum surface. Further, it is needless to say that the present invention includes an arrangement where a plurality of small-diameter needle-shaped conveying rollers are arranged along the sheet conveying path B.

In FIG. 7, the driving system 2 includes a main motor 18 which serves as a driving source for each portion of the copying machine, and a motive power transmitting system 19. In the figure, the motive power transmitting system 19 is shown as a black box and a specific arrangement thereof is not shown.

That is, in the copying machine in which this embodiment is to be employed, the driving force of the main motor 18 is transmitted, through the motive power transmitting system 19 including a gear train, a clutch mechanism and a link mechanism, to each driving portion including the resist roller pair 9, the drum 1, the transfer roller 11 and the conveying roller 17. At the motive power transmitting system 19, the speed ratio, the driving direction and the driving timing of each driving portion are associated mutually.

Thus, in this embodiment, in order that the sheet P is transported along the sheet conveying path B at a speed the same as the peripheral speed of the drum surface, the resist roller pair 9 and the conveying roller 17 are each rotated at a peripheral speed the same as the peripheral speed of the drum surface and in a direction to move the sheet P toward the drum, and the drum 1 is driven at a preset timing.

In the transferring apparatus of the arrangement described above, the resist roller pair 9 sends out the sheet P at a peripheral speed equal to the peripheral speed of the drum surface in correspondence with the rotation of the drum 1, thereby guiding the sheet P along the lower guide member 14 toward the drum. At this time, the sheet P comes into contact with the upper portion of the periphery of the conveying roller 17 just before it comes into contact with the drum surface, and is forcibly conveyed toward the drum by the conveying roller 17 at a peripheral speed equal to the peripheral speed of the drum surface, and after abutting the drum surface, it is sent to the guide table 15.

In this case, the rear surface of the sheet P abuts the conveying roller 17 just in front of the drum surface, whereby the sheet P is provided with a conveying power of a predetermined speed and is forcibly transported. At this time, since the sheet P is supported by the conveying roller 17 at its rear surface, it moves approximately in a direction of the tangential line with the conveying roller 17 without being weighed down by the dead load thereof, and immediately thereafter, the surface thereof abuts the drum surface. Thus, the sheet P is attracted to the drum surface due to the electrostatic force without its front end hanging down and separating from the drum surface, even when the resiliency thereof varies with environmental conditions such as the temperature and humidity.

Under a condition where the sheet P is in contact with the drum surface, since the sheet P is caught between the drum surface and the periphery of the conveying roller 17, it is provided with the driving force from the conveying roller 17 rotating at the same peripheral speed but in a reverse direction to the drum surface, and is transported in the conveying direction while being in contact with the drum surface at a constant contact pressure without any position shift.

While the sheet P is thus in contact with the drum surface, a voltage of a polarity reverse to that of the toner image on the drum surface is applied to the transfer roller 11 by the power source 12, and by the Coulomb's force generated thereby, the charged toner adhering to the drum surface is transferred onto the sheet P. Thus, image unevenness never occurs in the image transferred onto the sheet P.

The sheet P onto which the image has been transferred is separated from the drum surface, and after its front end reaches the upper surface of the guide table 15, its rear end is separated from the resist roller pair 9. Then, the sheet P is transported along the guide table in accordance with the rotation of the drum 1 and sent to the fixing roller pair 10 by way of the sheet guide 16.

Figure 8:
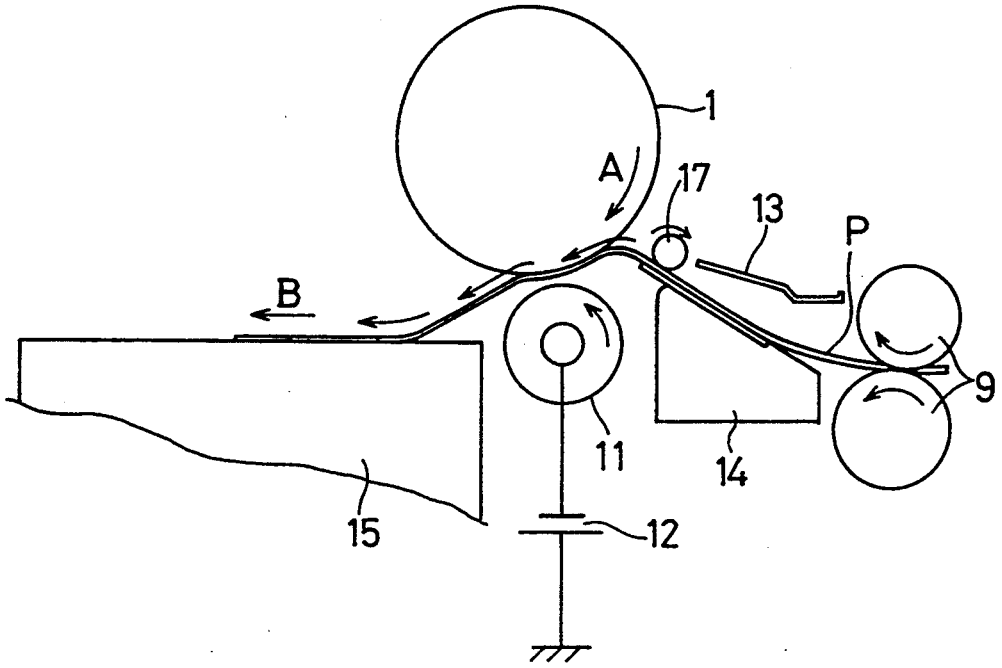
FIG. 8 schematically shows a relevant portion of a copying machine incorporating a transferring apparatus which is a second embodiment of the present invention.

Referring to FIG. 8, there is shown a second embodiment of the present invention. The transferring apparatus according to this embodiment is different from the apparatus of the above-described first embodiment in the arrangement position of the conveying roller 17. In this embodiment, the same elements as those of the above-described first embodiment are identified by the same reference designations, and no description thereof will be given to avoid repetition.

That is, the conveying roller 17 is arranged to be nearly in contact with the downstream side end portion of the slanting upper surface of the lower guide member 14 provided on the sheet conveying path B, and is designed so that it is rotated at a peripheral speed the same as the peripheral speed of the drum surface in the same direction and that an upper portion of its periphery abuts the surface of the sheet P.

In this arrangement, the sheet P transported along the sheet conveying path B is caught between the lower guide member 14 and the conveying roller 17 when it reaches the downstream side end portion of the lower guide member 14, and is forcibly conveyed toward the drum surface by the conveying roller 17.

In this case, since the downstream side end portion of the lower guide member 14 is arranged as close to the drum 1 as possible and the conveying roller is therefore located close to the drum surface, in a manner similar to the above-described first embodiment, the sheet P is transported in the conveying direction by means of the driving force from the conveying roller while being in contact with the drum surface with a constant contact pressure without any position shift.

Figure 9:
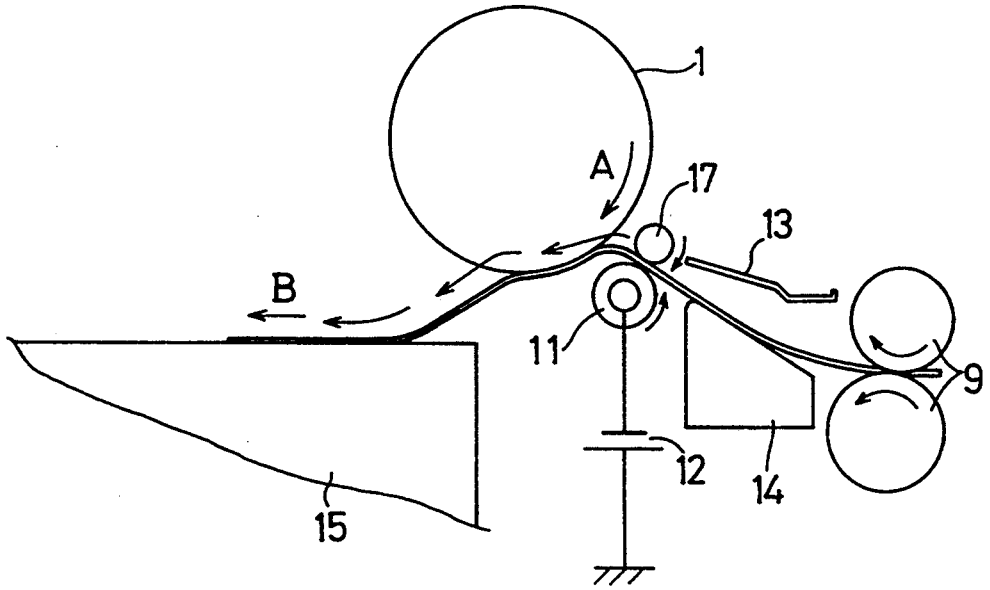
FIG. 9 schematically shows a relevant portion of a copying machine incorporating a transferring apparatus which is a third embodiment of the present invention.

Referring to FIG. 9, there is shown a third embodiment. In the transferring apparatus according to this embodiment, the conveying roller 17 is arranged above the transfer roller 11 in such manner that its periphery abuts the periphery of the transfer roller 11. In this embodiment, the same elements as those of the above-described embodiments are identified by the same reference designations, and no description thereof will be given to avoid repetition.

That is, in this embodiment, the position of the transfer roller 11 is moved to the upstream side, on the sheet conveying path, as compared to those of the above-described embodiments, and is arranged in such manner that a gap larger than the thickness of the sheet P is secured between the drum surface and the roller 11. The transfer roller 11 and the conveying roller 17 rotatively in contact with it are rotated at a peripheral speed the same as the peripheral speed of the drum surface.

It is needless to say that the conveying roller 17 is rotated in a direction the same as the rotation direction of the drum 1 and the transfer roller 11 is rotated in a direction opposite thereto. Moreover, the lower guide member 14 is arranged in such manner that its downstream side end portion is as close to the portion at which the rollers 11 and 17 are rotatively in contact as possible, and the contact portions of the rollers 11 and 17 are located on an extension of the slanting upper surface of the lower guide member 14.

In this arrangement, the sheet P transported along the sheet conveying path B is caught between the transfer roller 11 and the conveying roller 17 when the front end thereof is separated from the lower guide member 14, and is forcibly conveyed toward the drum surface by the conveying roller 17.

In this case, since it is necessary to arrange the conveying roller 17 to be as close to the drum surface as possible and it is necessary to arrange the transfer roller 11 at a predetermined position where the periphery of the transfer roller 11 is located close to the drum surface, it is preferable to use a short-diameter roller as the transfer roller 11.

With this arrangement, since the conveying roller 17 is located close to the drum surface, similarly to the above-described embodiments, the sheet P is transported in the conveying direction by the conveying roller while being in contact with the drum surface at a constant contact pressure without any position shift.

In the arrangement like that of the above-described second embodiment where the conveying roller 17 is arranged above the lower guide member 14, the conveying roller 17 is rotatively in contact with the sheet P to perform its auxiliary conveying function while the sheet P is passing between the conveying roller 17 and the lower guide member 14, whereas while the sheet P is not being supplied or when no sheet P is present, the conveying roller 17 is directly in contact with the upper surface of the lower guide member 14.

Consequently, while the conveying roller 17 is being driven, the conveying roller 17 slides on the upper surface of the lower guide member 14 which is stationary to cause a strange noise, or the roller 17 may be damaged because of an excessive load torque applied to the roller 17 due to the friction generated by the sliding.

For the purpose of solving this problem, the inventors of the present invention arranged the conveying roller 17 at a position where a predetermined gap is left between the upper surface of the lower guide member 14 and the roller 17. As a result, the auxiliary conveying operation of the sheet P by the conveying roller 17 effectively worked, and further, it was found that since the roller 17 was out of contact with the lower guide member 14, the problem of the strange noise and the problem caused by the load torque applied to the roller 17 are completely solved.

Figure 10:
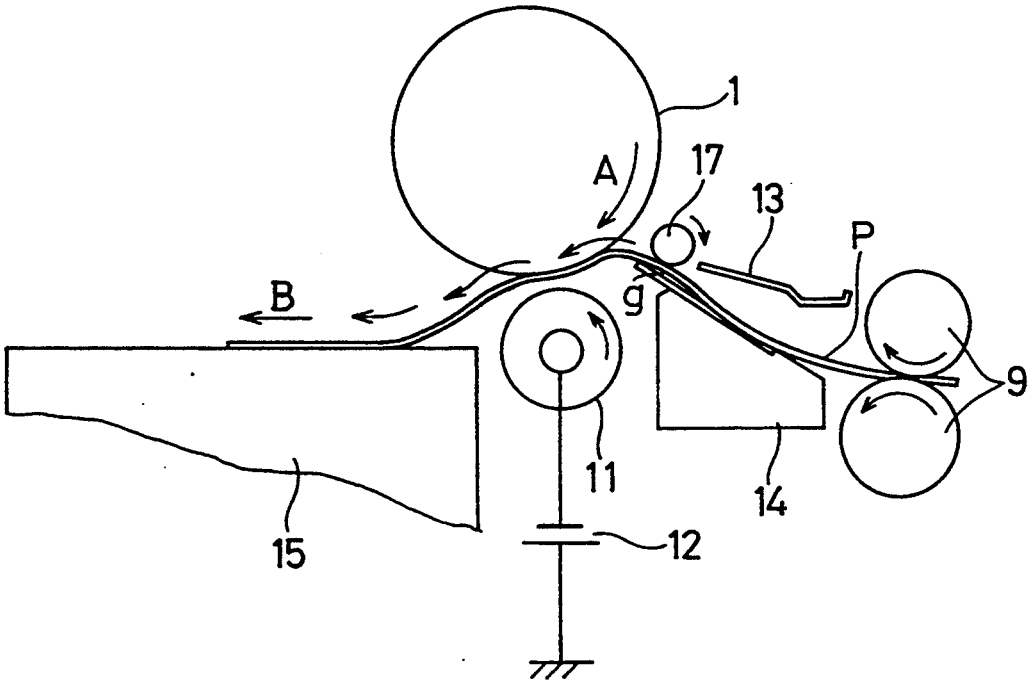
FIG. 10 schematically shows a relevant portion of a copying machine incorporating a transferring apparatus which is a fourth embodiment of the present invention.
Figure 11:
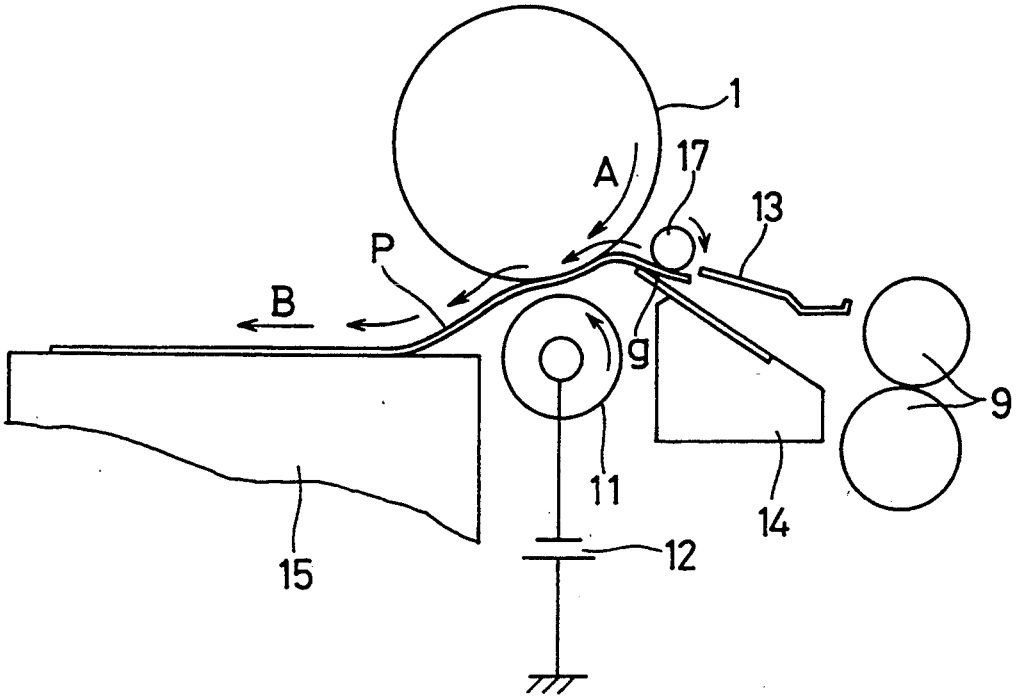
FIG. 11 shows an operation of the transferring apparatus of FIG. 10.
Figure 12:
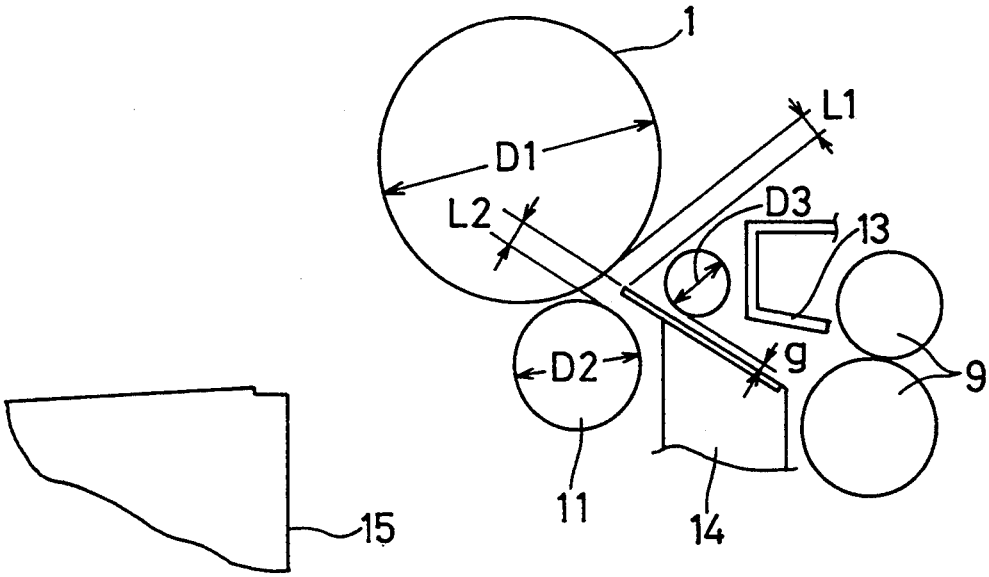
FIG. 12 shows an example of a specific size of each portion of the transferring apparatus of FIG. 10.

FIGS. 10 to 12 shows specific examples of the arrangement where the conveying roller 17 is arranged at a position where a predetermined gap is left between the flat upper surface of the lower guide member 14 and the roller 17. In a fourth embodiment shown in these figures, the same elements as those of the above-described embodiments are identified by the same reference designations, and no description thereof will be given to avoid repetition.

That is, in this embodiment, the conveying roller 17 is arranged with a predetermined gap g between at a position opposite the flat slanting upper surface of the lower guide member 14 provided on the sheet conveying path B, particularly at a position opposite the downstream end portion of the upper surface which is located as close to the drum surface as possible. Moreover, the conveying roller 17 is designed to be rotated at a peripheral speed the same as the peripheral speed of the drum surface in the same direction.

In this arrangement, the sheet P transported along the sheet conveying path B by the rotation of the resist roller pair 9 passes between the conveying roller 17 and the lower guide member 14 without being in contact with the roller 17 until its front end reaches the drum surface. Then, after the front end of the sheet P has abutted the drum surface, the sheet P is attracted to the drum surface due to the electrostatic force while being bent and deformed along the transfer area on the drum surface and is conveyed while being in close contact with the drum surface.

At this time, as shown in FIG. 10, the sheet P receives a reaction force from the drum surface and is bent by its own resiliency between the drum surface and the front end of the lower guide member 14, whereby the bent portion of the sheet P is pressed onto the conveying roller 17 so that the conveying roller 17 provides the sheet P with a driving force in the conveying direction.

When the sheet P is conveyed and separated from the resist roller pair 9 as shown in FIG. 11, since the rear end of the sheet P is bent upward due to its own resiliency to come in contact with the conveying roller 17, the conveying force of the conveying roller 17 continues to be transmitted to the sheet P. Since the conveying roller supplements the conveying force of the sheet P after the sheet P is separated from the resist roller pair 9, the conveying condition of the sheet P is approximately the same as that when the sheet P is caught between the resist rollers 9.

As described above, in this embodiment, by setting an appropriate position relationship among the portion on the drum surface at which the drum surface is rotatively in contact with the sheet P, the front end portion of the lower guide member 14 and the position of the conveying roller 17, the sheet P is made capable of bending between the drum surface and the front end portion of the lower guide member 14, and by using the resiliency of the sheet P generated thereby, the sheet P is brought into contact with the conveying roller 17 so that it may be forcibly conveyed.

FIG. 12 shows an example of a specific size of each portion in the arrangement of this embodiment. In the arrangement shown in this figure, when the diameter D1 of the drum is 30 mm and the diameter D2 of the transfer roller 11 is 14 mm and the diameter D3 of the conveying roller 17 is 6.5 mm, the gap L1 between the drum surface and the front end portion of the lower guide member 14 is 3 mm and the gap L2 between the upper surface of the lower guide member 14 and the periphery of the transfer roller 11 is 2.2 mm. The gap g between the upper surface of the lower guide member 14 and the periphery of the conveying roller 17 is 0.2 to 1 mm. The size of the gap g is not limited to the above range.

In the arrangement where each portion is of the above size, the sheet P is conveyed until it is close to the drum surface and when it is finally separated from the conveying roller, the distance between the remaining sheet P and the drum surface is short such as 10 mm or less, the sheet is attracted to the drum surface due to the electrostatic force and is conveyed without any disorder.

While a photoreceptor drum which rotates as an electrostatic latent image carrier is used in the above-described embodiments, the present invention may be employed for an arrangement where an endless belt type photoreceptor which circularly moves is used. Moreover, as the charge supplying means, a member which is fixed at a position opposite the drum may be used instead of a rotating roller such as the transfer roller.

As described above, according to the transferring apparatus of the present invention, not only the problems that the toner located at a central portion of the drum is not transferred to the sheet and that toner scatters and adheres to a peripheral portion of the image transferred onto the sheet are prevented by arranging the charge supplying means so as to be out of contact with the surface of the electrostatic latent image carrier, but also the sheet may be in contact with the surface of the carrier at a sufficient contact pressure by providing a stable conveying force to the transfer sheet by the conveying roller and immediately thereafter bringing the sheet into contact with the surface of the carrier along the surface of the carrier. Consequently, even when the resiliency of the sheet varies with environmental conditions such as the temperature and humidity, the sheet may be brought into contact with the surface of the carrier at a stable contact pressure. As a result, an excellent image without any blur is obtained on the sheet.

Moreover, after the rear end of the transfer sheet is separated from the resist roller pair, the sheet is bent by its own resiliency between the surface of the carrier and the front end portion of the guide member, and thereby, the bent portion of the sheet is pressed onto the transfer roller, so that a driving force in the conveying direction is provided from the conveying roller. Consequently, after the sheet is separated from the resist roller pair, the conveying roller supplements the conveying force of the sheet P until the sheet, from its front to rear ends, is attracted to the surface of the carrier due to the electrostatic force. As a result, the sheet from its front to rear ends, may be brought into contact with the surface of the carrier at a stable contact pressure.

Further, since the transfer roller which rotates at a peripheral speed the same as the movement speed of the carrier is arranged at a position which is opposite the upper surface of the guide member with a predetermined gap, preferably of 0.2 to 1 mm, between and where the roller is close to but out of contact with the electrostatic latent image carrier, even while no sheet is being supplied between the upper surface of the guide member and the conveying roller, the problems never occur that a strange noise is generated by the sliding of the conveying roller on the upper surface of the guide member and that the load torque of the conveying roller increases due to the friction caused by the sliding, and during transferring, smooth and quite operation condition is ensured.

Obviously, many modifications and variations of the present invention are possible in light of the above teachings. It is therefore to be understood that within the scope of the appended claims, the invention may be practiced other than as specifically described.

What is claimed is:

1. A transferring apparatus comprising:

an electrostatic latent image carrier moving in a direction corresponding to a conveying direction of a transfer sheet;

charge supplying means arranged at a position opposite the electrostatic latent image carrier with a sheet conveying path therebetween in such manner that a gap larger than a thickness of the transfer sheet is left between a surface of the electrostatic latent image carrier and the charge supplying means, said charge supplying means being charged reversely as compared to toner adhering to the surface of the electrostatic latent image carrier;

a conveying roller for forcibly conveying the transfer sheet in such direction that the sheet comes into contact with the surface of the electrostatic latent image carrier, said conveying roller being arranged at a position, on the sheet conveying path, which is close to but out of contact with the electrostatic latent image carrier; and roller driving means for rotating the conveying roller at a peripheral speed equal to a peripheral speed of the electrostatic latent image carrier, wherein said charge supplying means is constituted by a rotatable roller and said conveying roller is arranged so as to be rotatively in contact with a periphery of said rotatable roller.

2. A transferring apparatus according to claim 1, wherein said electrostatic latent image carrier is a rotating drum onto which a photosensitive material is applied.

3. A transferring apparatus according to claim 1, wherein said charge supplying means rotates in a direction opposite to a rotation direction of the conveying roller.

4. A transferring apparatus comprising:

a pair of resist rollers;

an electrostatic latent image carrier;

charge supplying means arranged at a position opposite the electrostatic latent image carrier with a gap larger than a thickness of a transfer sheet between, said charge supplying means being charged reversely to charged toner adhering to a surface of the electrostatic latent image carrier;

a guide member for guiding the transfer sheet in such direction that the sheet abuts the surface of the electrostatic latent image carrier at a predetermined angle, said guide member being arranged between the resist roller pair and the electrostatic latent image carrier; and a conveying roller arranged, opposite an upper surface of the guide member with a predetermined gap between, at a position close to but out of contact with the electrostatic latent image carrier.

5. A transferring apparatus according to claim 4, wherein the transfer sheet which abuts the surface of the electrostatic latent image carrier by way of the upper surface of the guide member is in close contact with the surface of the electrostatic latent image carrier while being bent and deformed along the surface of the electrostatic latent image carrier.

6. A transfer apparatus according to claim 5, wherein a distance between a surface of the conveying roller and the upper surface of the guide member is approximately 0.2 mm to 1 mm.

7. A transferring apparatus according to claim 4, wherein said charge supplying means is constituted by a rotatable roller.

8. A transferring apparatus according to claim 4, wherein said electrostatic latent image carrier is a rotating drum onto which a photosensitive material is applied.

* * * * *